US005427503A

United States Patent [19]

Haraga et al.

[11] Patent Number: 5,427,503

[45] Date of Patent: Jun. 27, 1995

[54] MULTI-STACKED CIRCULAR PLATE FAN PROVIDED WITH BLADES

[75] Inventors: Hisato Haraga; Yasuo Hamada; Katsushi Akamatsu, all of Kanagawa, Japan

[73] Assignee: Toto Ltd., Fukuoka, Japan

[21] Appl. No.: 974,877

[22] Filed: Nov. 12, 1992

[30] Foreign Application Priority Data

Mar. 15, 1991 [JP] Japan ..... 3-051191

[51] Int. Cl.[6] ..... F04D 29/38

[52] U.S. Cl. ..... 416/223 B; 416/178; 416/214 R

[58] Field of Search ..... 416/223 B, 214 R, 178; 415/206

[56] References Cited

U.S. PATENT DOCUMENTS

| | | | |
|---|---|---|---|
| 3,145,911 | 8/1964 | Helmbold | 416/178 |
| 3,426,965 | 2/1969 | Kulling | 416/214 |
| 3,856,434 | 12/1974 | Hoffmann | 416/214 |
| 4,329,118 | 5/1982 | Ranz | 416/178 |
| 4,634,344 | 1/1987 | Zagar et al. | 416/224 |

FOREIGN PATENT DOCUMENTS

| | | | |
|---|---|---|---|
| 1302030 | 4/1987 | U.S.S.R. | 416/223 B |
| 1521924 | 11/1989 | U.S.S.R. | 416/223 B |

*Primary Examiner*—John T. Kwon

*Attorney, Agent, or Firm*—Peter Jon Gluck; Morrison Law Firm; Thomas R. Morrison

[57] ABSTRACT

A multi-layer disk fan with blades operates quietly. The multi-layer disk fan with blades is formed by laminating a multiplicity of annular disks in a measured spaced relation, the arrangement having such a feature that a multiplicity of blades are interposed between the annular disks and the ends of the respective blades. The blades are further positioned a circumferentially measured spaced apart distance inward of the outer peripheral edges of the annular disks. Turbulent air flow caused by peeling-off at the tips of the blades through the effect of laminar flow by the disks is effectively prevented. Likewise, distortion in outlet speed at the outer peripheral edges of the annular disks is controlled, reducing noises from turbulent flow and interference and resulting in quiet operation.

9 Claims, 15 Drawing Sheets

MULTI-STACKED CIRCULAR PLATE FAN PROVIDED WITH BLADES

TECHNICAL FIELD

This invention relates to a multi-stacked circular plate fan provided with blades which can constantly obtain a sufficient amount of expelling air, while assuring a silent operation.

BACKGROUND

Conventionally as one of the fans which are capable of silent air-expelling operation, there is a multi-stacked circular plate fan X which is disclosed in Japanese laid-open publication 54-89602.

Such a multi-stacked plate fan provided with blades, as shown in FIGS. 25 and 26, substantially comprises a fan body 101 which is driven by a power operated-motor 100 which in turn is mounted on one end of a fan casing 110.

Upon operation of the power-operated motor 100, the fan body 101 is rotated so as to generate the air flow and expels the air from an air outlet 140.

Furthermore, as shown in FIG. 25, the fan body 101 comprises a multiplicity of thin annular circular plates 104 which are stacked together with a desired gap therebetween so that when the annular circular plates 104 are rotated, a shearing force is generated on the surface of these circular plates 104 in a circumferential direction. This shearing force works as a centrifugal force so as to generate an air flow thus providing a silent operation of the fan.

Furthermore, for providing a desired gap between the annular circular plates 104 and for making the flow of air from the inside to the outside smooth and increase the amount of air blow as shown in FIGS. 25 and 26, a plurality of arcuate blades 105 are disposed at a desired circumferential interval between the annular circular plates 104. The blades 105 also work as spacers.

However, the above mentioned multi-stacked plate fan X provided with blades still have following tasks to be resolved.

Namely, as shown in FIG. 26, every blade 105 has the trailing edge or the outermost outlet end extended to the outer peripheral portion of the annular circular plates 104. Therefore, at the outlet of the annular circular plates 104, as shown in FIGS. 26 and 27, a considerable distortion of velocity is generated in a circumferential direction and due to this distortion of velocity the pressure adjacent to the tongue portion of the casing fluctuates periodically thus generating the noise by rotation.

Furthermore, besides a tongue portion, during the course of rectifying the distortion of velocity, the turbulent flow is generated at the outer periphery of the annular circular plates 104, thus producing noise by the turbulant flow.

Furthermore, a portion of the air flow 106 which flows between the annular plates 104, 104 and locates at the rear portion of the blades 105 is peeled off so as to generate an air peeling-off region 108. Due to this peeling-off phenominon, a turbulent flow region 107 occurs at the outer periphery of the circular plate 104 and the turbulent flow noise is generated.

On the other hand, as shown in FIG. 26, the blade 105 has the leading edge or the inlet end thereof extended to the inner periphery of the circular plate 104.

Therefore, (1) as understood from the distribution curve of the absolute velocity 111 on the surface of the blade 105 as shown in FIG. 26, the velocity reduction ratio is greater on the inner end suction surface of the blade 105 than any other portion and, (2) the velocity reduction ratio at the inlet portion formed between the annular circular plates 104, 104 is greater than any other portion so that the air peeling-off phenominon is generated at the inner end suction surface of the blade 105. Furthermore, in case there is a velocity distortion relative to a circuferential direction at the inlet portion of the annular circular plates 104,104, an inflow angle of air toward the blade fluctuates and this also forms a part of the cause of the air peeling-off phenominon. Due to such a phenominon, a tubulence noise inside the annular circular plates 104, 104 also becomes greater.

Accordingly, it is an object of the present invention to provide a multi-stacked circular plate fan which can increase the amount of expelling air while assuring a silent fan operation.

DISCLOSURE OF INVENTION

The present invention discloses a multi-stacked circular plate fan provided with blades which is formed by stacking a multiplicity of annular circular plates while maintanining a measured spaced relation therebetween, characterized in that a multiplicity of blades are interposed between the annular circular plates and the trailing edge of the blade is positioned a circumferentially measured spaced relation to the inside from the outer periphery of the annular circular plate.

The present invention discloses a multi-stacked circular plate fan provided with blades which is formed by stacking a multiplicity of annular plates while maintanining a measured spaced relation therebetween, characterized in that the leading edge of the blade is positioned a circumferentially measured spaced relation to the outside from the inner periphery of the annular circular plate.

The present invention discloses a multi-stacked circular plate fan provided with blades which is formed by stacking a multiplicity of annular circular plates while maintanining a measured spaced relation therebetween, characterized in that a multiplicity of blades are interposed between the annular circular plates and the trailing edge of the blade is positioned a circumferentially measured spaced relation to the inside from the outer periphery of the annular circular plate while the leading edge of blade is positioned a predetermined distance to the outside from the inner periphery of the annular circular plate.

Furthermore, the present invention also is charaterized in that the multi-stacked circular plate fan provided with blades has following constructions.

(1) The distance $S_1$ between the outer periphery of the annular circular plate and the trailing edge of the blade is determined at a value expressed by a following formula.

$$0.3 < \frac{S_1}{l} \cdot \left[ \frac{Vu_1}{Vr_1} \right]^{\frac{1}{3}} < 1.2$$

In the formula, l: pitch between blades (mm)

$Vu_1$: tangential velocity of fluid at the radius of the trailing edge of the blade (m/s)

$Vr_1$: radial velocity of fluid at the radius of the trailing edge of the blade (m/s)

(2) The distance $S_2$ between the inner periphery of the annular circular plate and the inner end of the blade is determined at a value of $0.025 < S_2/r_2 < 0.125$ with relation to the radius $r_2$ of the leading edge of the blade.

(3) The blade is mounted in such a manner that it is inclined in a backward direction.

(4) An attack angle $\theta$ which is formed at the leading edge of the blade by a locus R of the fluid obtained by the circumferential velocity and radial velocity as relative velocities of fluid which flows between annular circular plates and lines $L_1$, $L_2$ which connects the leading edge and trailing edge of the blade is determined at $20° \pm 15°$.

(5) The relationship between a circumferential pitch angle $\alpha$ between blades and an angle $\beta$ defined by lines $L_3$, $L_4$ formed by connecting the leading edge and trailing edge of the blade with the center of the annular circular plate is determined at $0.5 < \beta/\alpha < 1$.

(6) The gap between the annular circular plates is determined at a value which is expressed by a following formula.

$$0.8 < \frac{\delta}{\pi(\nu/\omega)^{\frac{1}{2}}} < 4.0$$

In the formula, $\nu$=kinematic viscosity ($m^2/s$)

$\omega$=angular velocity (rad/s)

(7) The gap $\delta$ between the annular circular plates is determined at a value which is expressed by a following formula.

$$200 < \frac{\omega_1 \cdot \delta}{\nu} (=Re) < 3000$$

In the formula, $$u = \text{inner velocity of annular circular plate} = \frac{2 \cdot \pi \cdot r_2 \cdot n}{60} \text{ (m/s)}$$

$\omega_1$=relative velocity at the inlet portion between air and annular circular plate (m/s)

$\nu$=kinematic viscosity ($m^2/s$)

Re=Reynold's number

BEST MODE FOR CARRYING OUT THE INVENTION

Hereinafter, the multi-stacked circular plate fan provided with blades accoriding to the present invention is described in detail in view of several embodiments shown in the attached drawings.

First Embodiment

The embodiment, as shown in FIG. 1 to FIG. 6, discloses a multi-stacked circular plate fan A provided with blades characterized in that all of the blades have their trailing edge portions located a predetermined distance $S_1$ to the inner side from the outer circumferential edge of the annular circular plate 24.

In this embodiment, a multi-stacked circular plate fan A provided with blades is used as a hot air blow fan.

Figure 1:
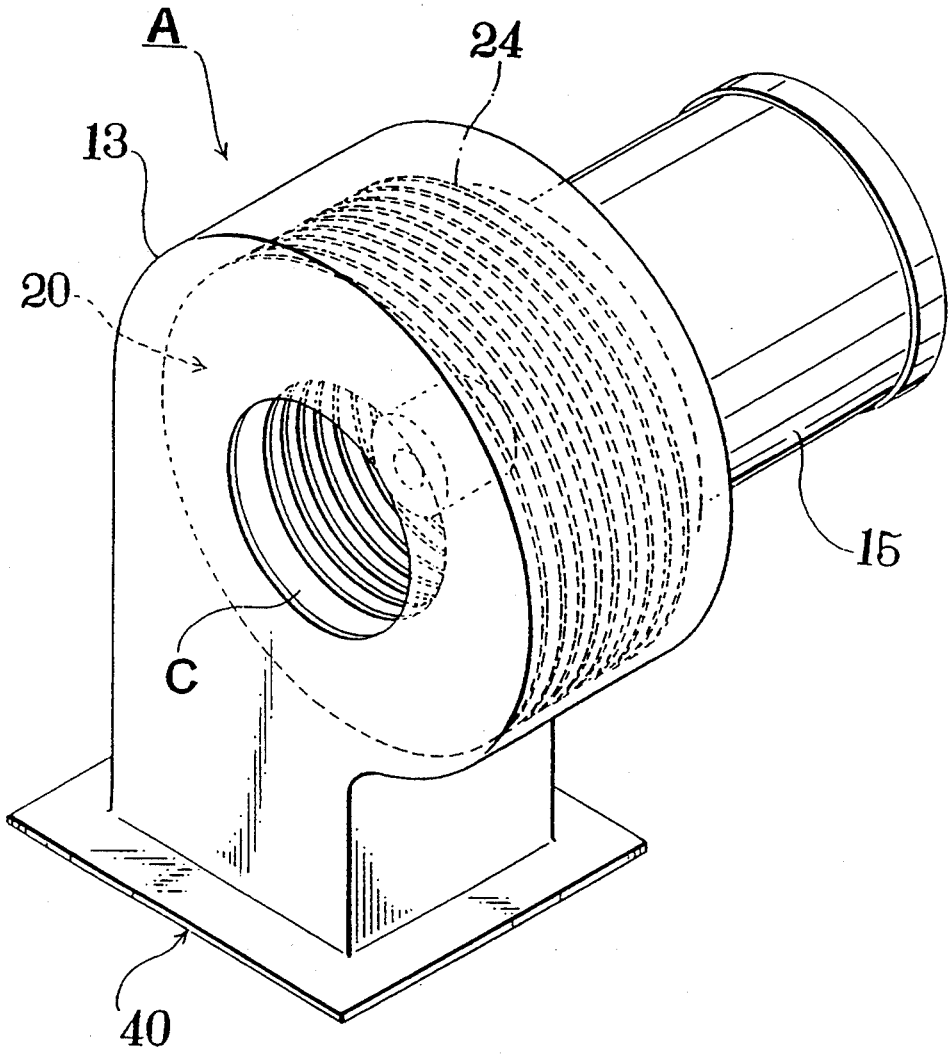
FIG. 1 is a perspective view of a multi-stacked circular plate fan provided with blades according to the first embodiment wherein the fan is used as a hot air blow fan.
Figure 2:
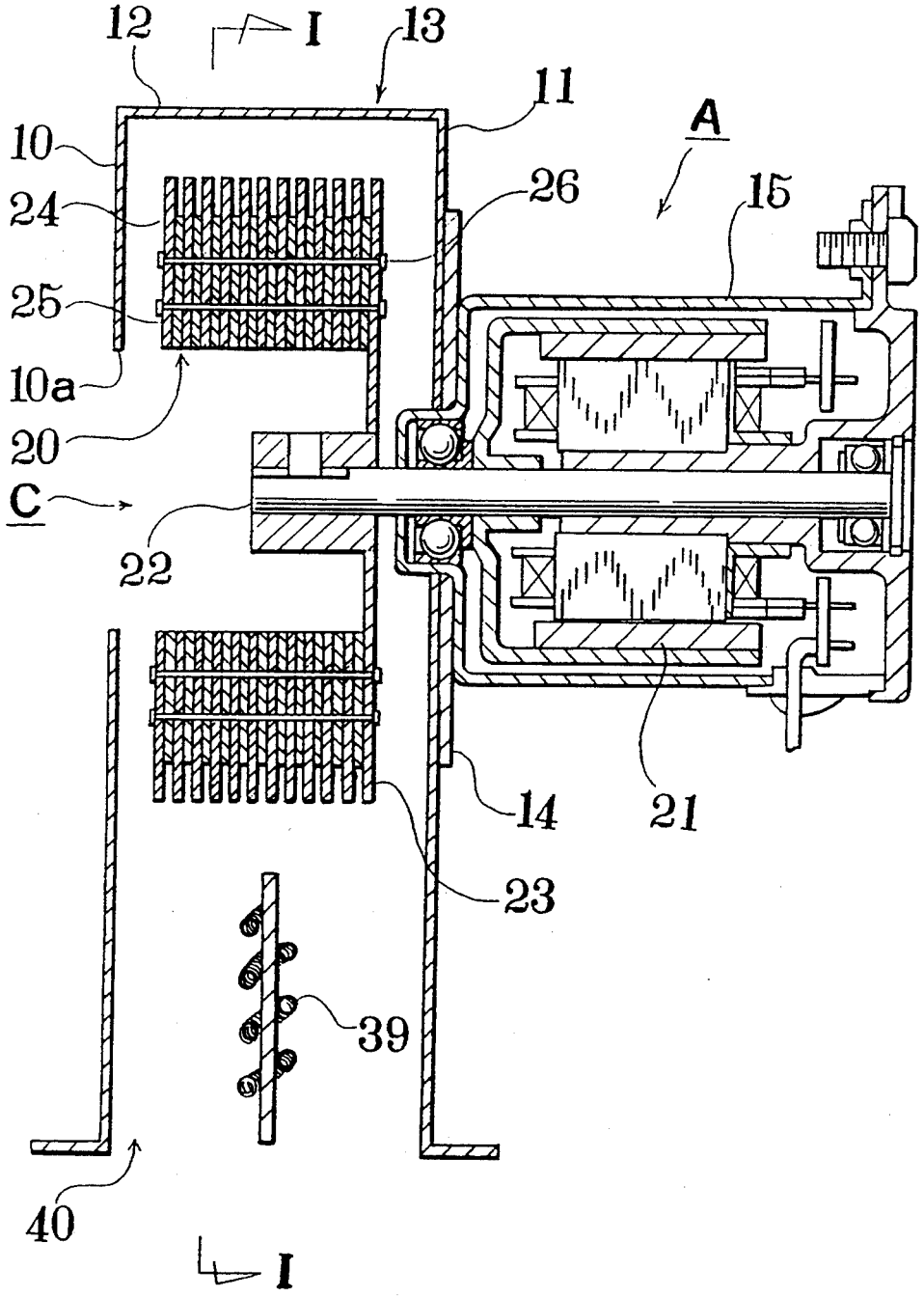
FIG. 2 is a cross-sectional side view of the fan.
Figure 3:
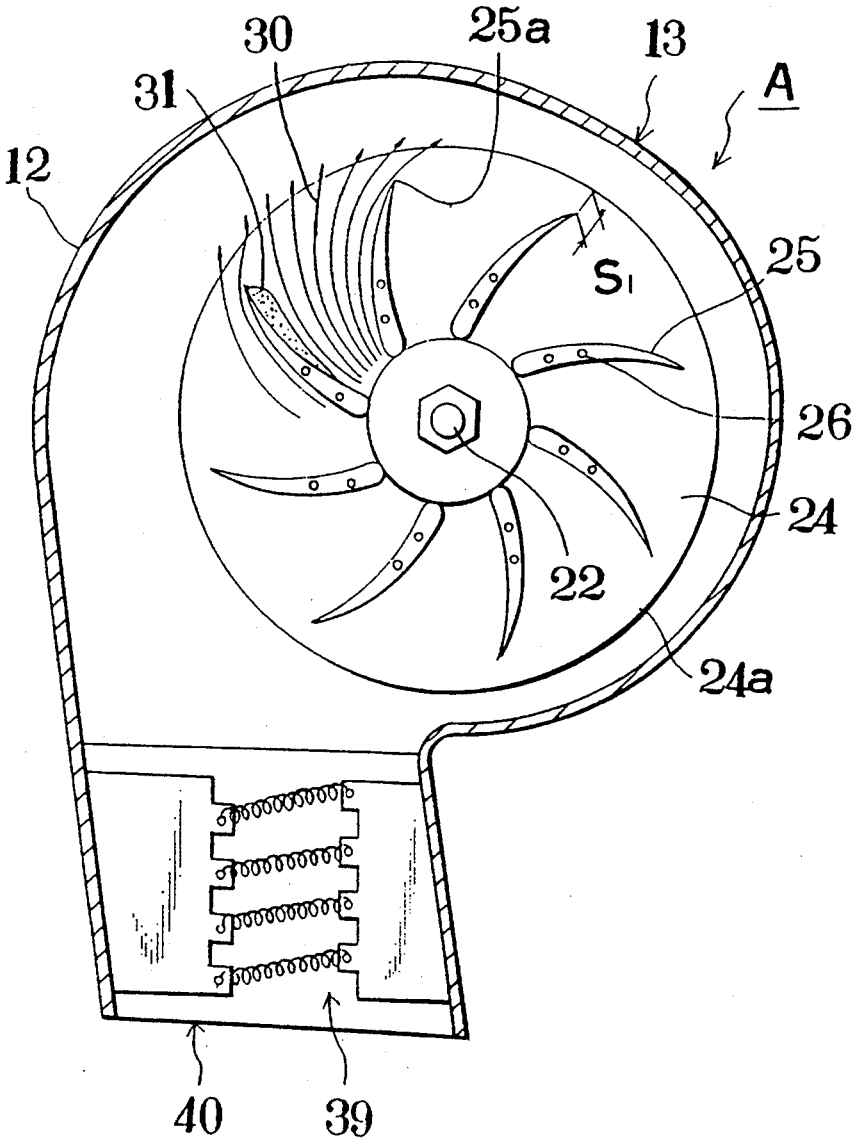
FIG. 3 is a transverse view taken along the line I—I of FIG. 2.

As shown in FIG. 1 to FIG. 3, a fan casing 13 of the multi-stacked circular plate fan A provided with blades comprises a front wall 10 and a rear wall 11 which are substantially circular and the circumferential edges of these walls, except a lower end opening portion (a drying air outlet port) 40, are connected to each other by an annular peripheral wall 12.

The fan casing 13, in this embodiment, is fixedly connected to a motor casing 15 by way of a support 14.

The fan casing 13 is provided with an air intake port 10a formed in the front wall 10, and comprises a fan body 20 disposed concentrically therein. The fan body 20 is connected to an output shaft 22 of a driving motor 21 disposed inside the support frame 14.

At the lower portion of the fan casing 13, there is disposed a heater 39 made of a nickel-chromium coil.

In the above basic construction, the present invention is characterized by the fan body 20 which is capable of silent air-expelling operation.

Figure 4:
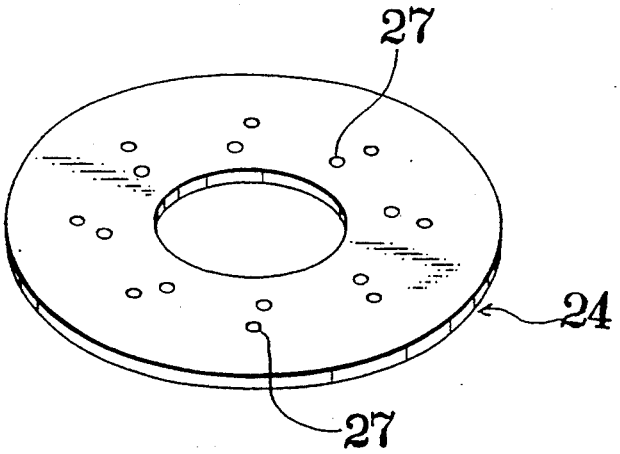
FIG. 4 is a perspective view of an annular circular plate.
Figure 5:
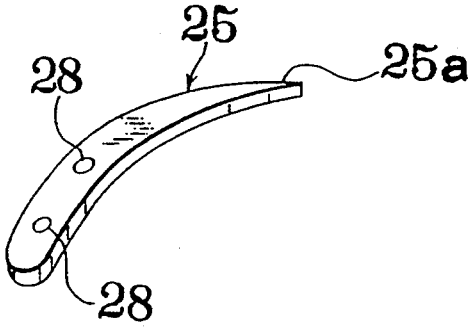
FIG. 5 is a perspective view of a blade.

Namely, as shown in FIG. 2, FIG. 4 and FIG. 5, the fan body 20 is substantially constructed by stacking a multiplicity of thin annular circular plates 24 on a base circular plate 23, with spacers 25 interposed to provide a predetermined gap or spacing $\delta$ between adjacent ones of the circular plates.

The predetermined gaps $\delta$ includes not only equal spacings but also irregular spacings.

The annular circular plate 24, as shown in FIG. 3, has a donut-like shape and is provided with apertures 27 for passing connecting pins 26 therethrough in predetermined circumferential pitches.

The predetermined circumferential pitch includes not only the equal pitch but also the irregular pitch.

The blade 25 is, as shown in FIG. 5, made of a thin arcuate piece and is provided with an aperture 28 through which the connecting pin 26 passes.

In assembling the fan body 20 shown in FIG. 2, a multiplicity of annular circular plates 24 and a multiplicity of blades 25 are stacked alternatively on the base circular plates 23 by making the connecting pins 26 pass through the apertures 26, 27 and then the ends of connecting pins 26 are coaked on the surface of the last annular circular plates 24. Furthermore, in this embodiment, as shown in FIG. 3, the trailing edges 25*a* of all the blades 25 are positioned a predetermined distance $S_1$ to the inside from the outer periphery end of the annular circular plate 24.

Due to such a construction, upon rotation of the fan body 202 the air is radially flown to the outside of the fan body 20 from the central space C defined inside the multiplicity of stacked annular circular plates 24 passing through the air passage 30 formed between the annular circular plates 24, 24. Thereafter, the air is expelled outside from the annular circular plates 24. In this operation, the turbulence 31 generated by the peeling-off of air at the rear portion of the blades 25,25 between the annular circular plates 24, 24 can be suppressed due to the influence of viscocity caused by the wall surface of the annular circular plates 24, thus effectively preventing the occurance of turbulent flow 31 and the turbulent flow noise caused by the turbulent flow.

Figure 6:
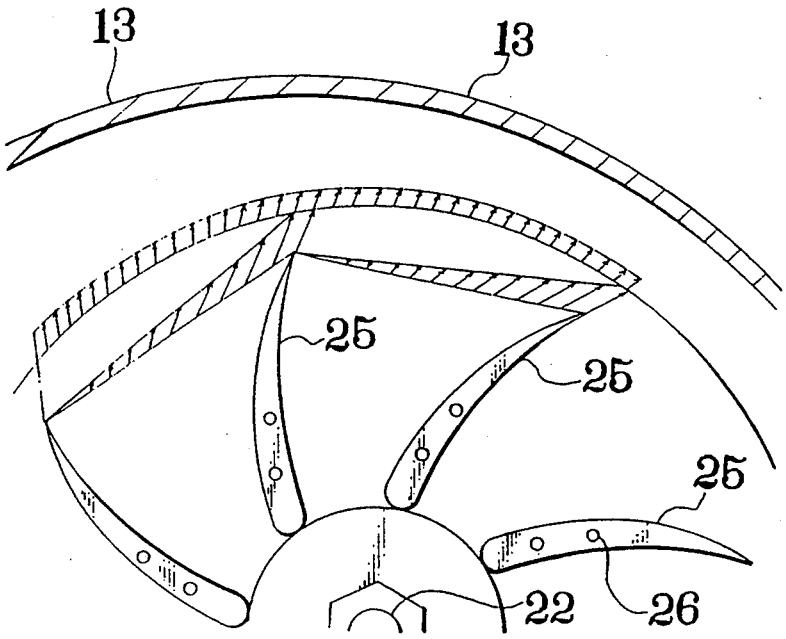
FIG. 6 is an explanatory view showing the flow velocity of air flow at the outer periphery of the annular circular plate.

Furthermore, within a predetermined distance $S_1$ to the outer periphery of the annular circular plates 24, owing to the influence of a shearing force generated on the wall surface of the annular circular plates 24, 24, the velocity distortion caused between the trailing edges of the adjacent blades 25, 25 is alleviated as shown in FIG. 6 and the velocity distribution curve becomes uniform at the outlet of annular circular plates 24. Accordingly, the pressure fluctuation adjacent to the tongue portion is disappeared and the interference noise is attenuated thus preventing the occurance of the turbulent noise caused by the velocity distortion.

Furthermore, due to the influence of the outside portion of the circular plates 24 such as the tongue portion or the blow-out portion, the flow of air insides the row of blades is periodically changed and causes the lowering of pressure and velocity. However, since the trailing edge of the blade 25 is positioned a predetermined distance $S_1$ inside from the outer periphery of the annular circular plate 24, the boundary condition at the outlet of the blade 25 becomes stable and the flow angle of air expelled from the blade 25 becomes always constant so that the stable air expelling operation is achieved.

The distance $S_1$ from the trailing edge 25*a* of the blade 25 to the outer periphery of the annular circular plate 24 should preferably meet the value expressed by a following formula according to an experiment carried out by the applicant.

$$0.3 < \frac{S_1}{l} \cdot \left[\frac{Vu_1}{Vr_1}\right]^{\frac{1}{3}} < 1.2 \tag{1}$$

In the above fundamental formula, l: pitch between blades (mm)

$Vu_1$: tangential velocity of fluid at the radius of the trailing edge of the blade (m/s)

$Vr_1$: radial velocity of fluid at the radius of the trailing edge of the blade (m/s)

Here, the pitch l between blades, the tangential velocity $Vu_1$ of fluid and the radial velocity Vri of fluid can be obtained with following formulae respectively.

$$l = 2\pi r_1/Z \tag{2}$$

In the above formula, $r_1$: radius of trailing edge of the blade

Z: number of blades $$\frac{Vu_1}{u_1} = 1 - \frac{A}{12\pi R^2} + \left(\frac{A}{12\pi} - 1\right)\frac{1}{R^2} \cdot e^{12\pi\cdot(1-R2)/A} \tag{3}$$

In the above formula, $u_1$: circumferential speed of annular circular plate 24 at the radius of the trailing edge of the blade ($=2\pi rn/60$)

n: number of rotation of annular circular plate (rpm)

A: non-dimentional flow amount ($=q\delta/\nu\ r_i^2$)

q: amount of air flow which passes between the annular circular plates ($m^2/s$)

$\delta$: gap between the annular circular plates (m)

$\nu$: kinematic viscosity ($m^2/s$)

ri: radius of annular circular plate at inlet (m)

R: $r_1/r_i$ $$Vr_1 = \frac{q}{2\pi r_1 \cdot \delta} \tag{4}$$

In the above fundamental formula (1), $(S_1/l)$ is a value which relates to making the flow velocity distribution curve uniform with the presence of the distance $S_1$ as shown in FIG. 6, while $(Vu_1/Vr_1)$ is an air mixing effect by the tangential velocity.

Figure 7:
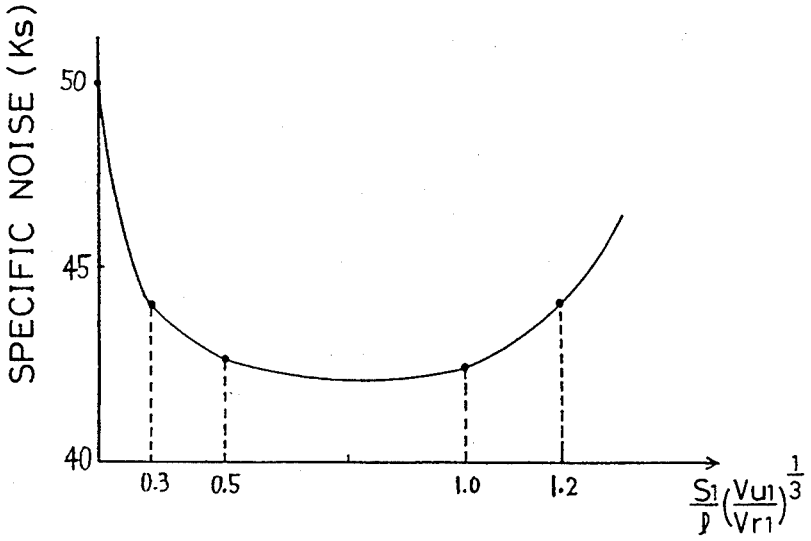
FIG. 7 is a graph showing the specific noise level of the multi-stacked circular plate fan provided with blades.

Meanwhile, in FIG. 7, a graph is shown in which the above-mentioned $(S_1/l)\cdot(Vu_1/Vr_1)^{\frac{1}{3}}$ is taken on the abscissa and the specific noise level ks (dB(A)) is taken on the ordinate.

The specific noise level ks can be obtained by a formula ($ks=Lsp-10\log QP^2$.

In the formula,

Q=expelling air amount of blower or fan ($m^2/s$)

P=pressure head of blower of fan (mmAq)

Lsp=sound pressure level of blower or fan (dB (A))

As can be readily understood from the graph, in case of $0.3<(S_1/l)\cdot(Vu_1/Vr_1)^{\frac{1}{3}}<1.2$, the specific noise ks is reduced, and especially, in case of $0.5<(S_1/l)\cdot(Vu_1/Vr_1)^{\frac{1}{3}}<1.0$, the specific noise is considerably reduced.

From this result, it is found that the distance $S_1$ is interrelated with the pitch l between blade, the tangential velocity $Vu_1$ of fluid and the radial velocity $Vr_1$ of fluid and that the distance $S_1$ should be smaller relative to the pitch between the blades while the velocity $Vu_1$ should be greater relative to the velocity $Vr_1$.

However, if the distance $S_1$ is excessively greater, the length of line which connects blades becomes short so that the working effected by the blade is lowered and thus the air expelling capacity is lowered resulting in the greater noise. Accordingly, the optimal range exists in the above formula.

Hereinafter, the operation of the multi-stacked circular plate fan A provided with blades which is used as the hot air blow fan will be explained in view of FIG. 2 and FIG. 3.

When the operator pushes an operation switch which is not shown in the drawing, the fan operating motor 21 and the heater 39 are operated.

As the fan operating motor 21 is driven, the fan body 20 is rotated and the air is sucked into the fan casing 10 from the outside through the air inlet 10*a* and the air passes through the gaps formed between multi-stacked circular plates 24, 24 , while exhibiting the uniform distribution in terms of amount or air from the inlet opening to the bottom of the fan blade. Thereafter, the downward air flow is generated and the air is heated by the heater 39 and is blown outside from the hot air blow-off outlet 40.

Furthermore, in the above rotation of the fan body 20, since the trailing edge 25*a* of the blade 25 is positioned a predetermined distance $S_1$ to the inside from the outer periphery 24*a* of the annular circular plate 24, at the trailing edge of the blade 25, any turbulent flow which may be caused by the peeling-off phenominon can be effectively suppressesd and furthermore since no outlet velocity distortion occurs at the outer periphery 24*a* of the annular circular plate 24*a*, the turbulent noise and the interference noise are attenuated thus enabling the silent air-expelling operation.

Second Embodiment

Figure 8:
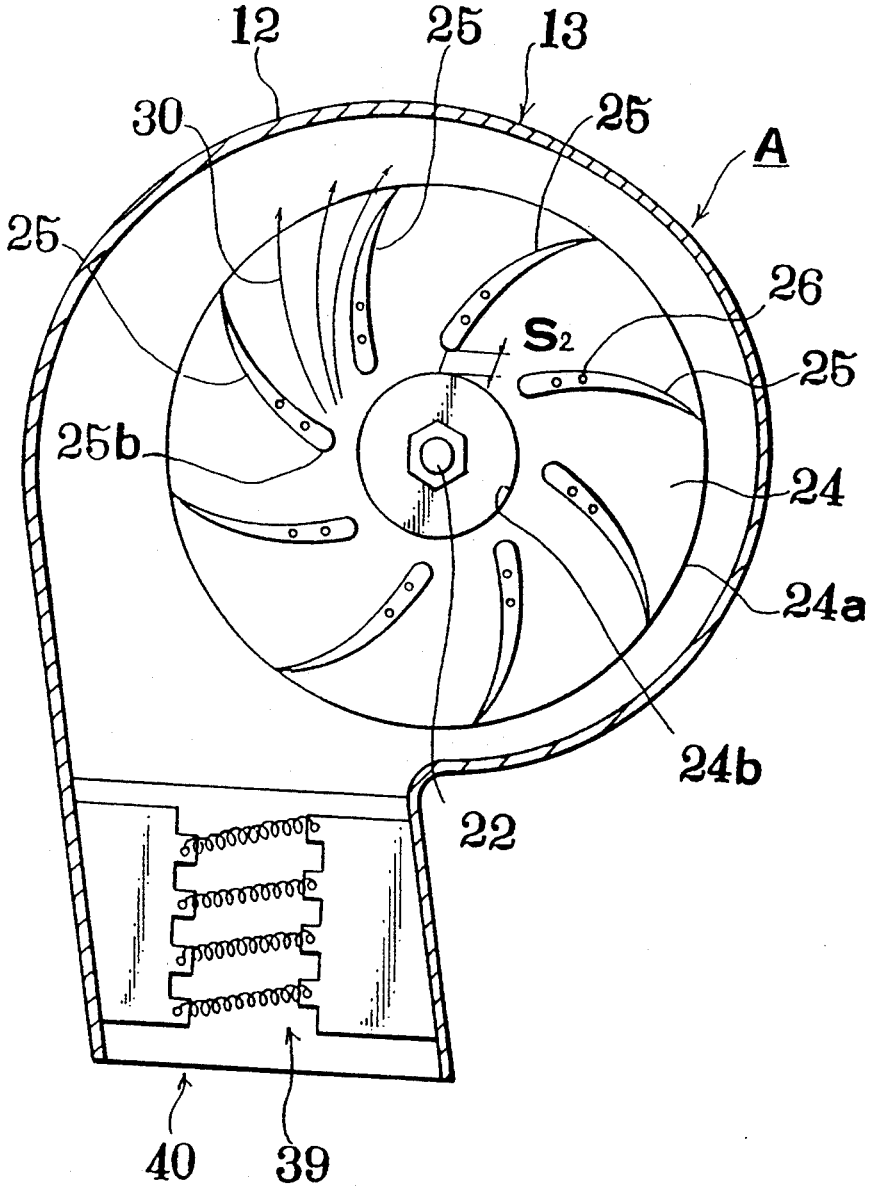
FIG. 8 is a cross-sectional front view of a multi-stacked circular plate fan provided with blades according to the second embodiment.

The multi-stacked circular plate fan A provided with blades according to this embodiment, as shown in FIG. 8, substantially has the same construction as that of the first embodiment. Namely, the multi-stacked circular plate fan A provided with blades is constructed by stacking a multiplicity of annular circular plates 24 while forming a desired gap δ therebetween. Accordingly, in FIG. 8, the like construction and like parts are denoted by the same numerals.

However, in this embodiment, different from the first embodiment, as shown in FIG. 8, the occurrence of the turbulent flow caused by the peeling-off of air is prevented only at the inner periphery of the annular circular plates 24, 24.

Namely, a multiplicity of blades 25 which are interposed between the annular circular plates 24,24 have their respective leading edge 25*b* positioned a predetermined distance $S_2$ to the outside from the inner periphery of the annular circular plate 24.

Due to such a construction, the turbulent flow noise which tends to occur at the inner peripheral side of the annular circular plate 24 by the peeling-off of air can be effectively suppressed. Even in case that the distortion of velocity in a circumferential direction exists at the inlet opening of the annular circular plates 24, the velocity distribution becomes uniform within the predetermined distance $S_2$ so that the inflow angle of air toward the blade becomes stable thereby enabling the stable and silent fan operation without the peeling-off of air.

According to an experiment carried out by the applicant, it was found that the distance $S_2$ from the leading edge 25*b* of the blade 25 to inner peripheral side 24*b* of the annular circular plate 24 should take following value.

$$0.025<S_2/r_2<0.125 \quad (5)$$

In the formula, $r_2$: radius at the leading edge of the blade

Figure 9:
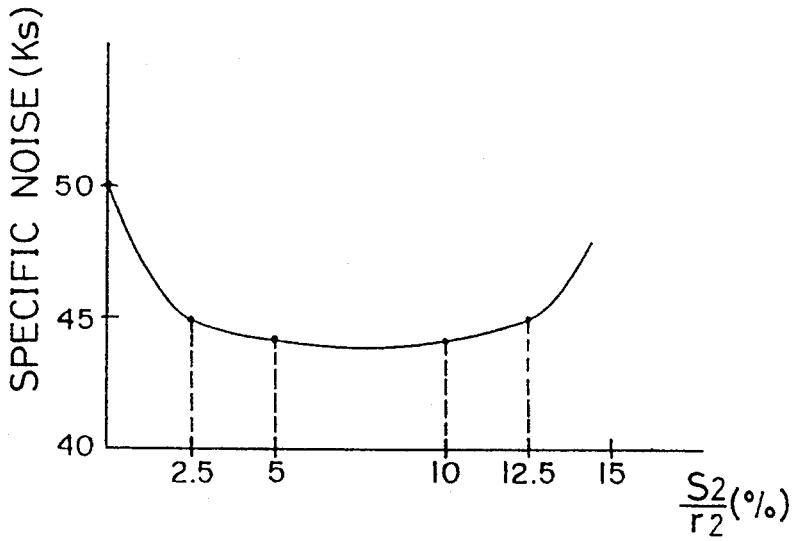
FIG. 9 is a graph showing the specific noise level of the multi-stacked circular plate fan provided with blades.

Namely, in a table (Table 1) below, specific noise levels ks which were the result of the experiment carried on by varying the distance $S_2$ (mm) from the leading edge 25*b* of the blade 25 to the inner peripheral side 24*b* of the annular circular plate 24 and the radius (mm) of the leading edge of the blade respectively are described, while FIG. 9 is a graph prepared by taking the $S_2/r_2$ on the abscissa and the specific noise level ks (dB (A)) on the ordinate.

The specific noise level ks is obtained by the formula $ks=Lsp-10\log QP^2$ as in the case of the first embodiment.

TABLE 1

| $S_2$ | $r_2$ | $S_2/r_2\times 100$ | $k_s$ |
|---|---|---|---|
| 0 | 70 | 0 | 50 |
| 1.8 | 71.8 | 2.5 | 45 |
| 4 | 74 | 5.4 | 44 |
| 7.5 | 77.5 | 9.7 | 44 |
| 10 | 80 | 12.5 | 45 |

As can be understood from the above table and the graph in FIG. 9, in case $S_2/r_2$ is $0.025<S_2/r_2<0.125$, the specific noise ks was attenuated. Especially, in case $S_2/r_2$ is $0.05<S_2/r_2<0.10$, the specific noise ks was considerably attenuated.

For preventing the noise, it is desirable to make the distance $S_2$ from the leading edge 25*b* of the blade 25 to the inner peripheral side 24*b* of the annular circular plate 24 longer relative to the radius $r_2$ of the leading edge 25*b* of the blade 25. However, if the distance $S_2$ is too long, the straight line which spans both ends of the blade 25 is shortened and the function of the blade 25 is deteriorated and eventually the specific noise ke is increased. Accordingly, $S_2/r_2$ should be chosen in the above determined most optimal range.

Third Embodiment

Figure 10:
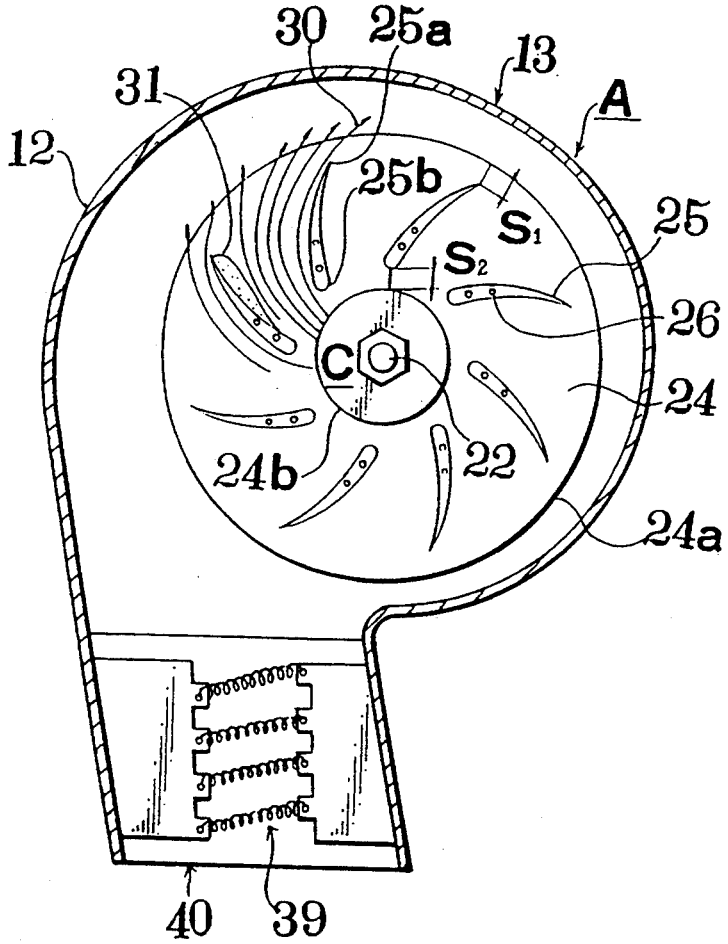
FIG. 10 is a cross-sectional front view of a multi-stacked circular plate fan provided with blades according to the third embodiment.

The multi-stacked circular plate fan A provided with blades according to this embodiment, as shown in FIG. 10, substantially has the same construction as that of the first embodiment. Namely, the multi-stacked circular plate fan A provided with blades is constructed by stacking a multiplicity of annular circular plates 24 while forming a desired gap δ therebetween. Accordingly, in FIG. 8, the like construction and like parts are denoted by the same numerals.

However, in this embodiment, different from the first embodiment, as shown in FIG. 10, the occurrence of the turbulent flow caused by peeling-off of the air is prevented not only at the inner periphery of the annular circular plates 24,24 but also at the outer periphery of the annular circular plates 24,24.

Namely, a multiplicity of blades **25*b* which are interposed between the annular circular plates 24,24 have their respective trailing edges 25*a* positioned a predetermined distance $S_1$ to the inside from the outer periphery 24*a* of the annular circular plate 24 and have their respective leading edges 25*b* positioned a predetermined distance $S_2$ to the outside from the inner periphery 24*b* of the annular circular plate 24**.

Due to such a construction, the turbulent flow noise and the interference noise which respectively tend to occur at the inner and outer peripheral sides of the annular circular plate 24 by the velocity distortion and the peeling-off of air can be effectively suppressed.

Fourth Embodiment

The multi-stacked circular plate fan A provided with blades according to this embodiment is characterized by the desirable mounting angle of the blades 25 on the annular circular plates 24 which gives rise to the silent air-expelling operation of the circular plate fan A.

The present embodiment is explained in detail hereinafter in conjuntion with the attached drawings FIG. 2, FIG. 3 and FIG. 11 to FIG. 15.

As shown in FIG. 2 and FIG. 3, in the multi-stacked circular plate fan A provided with blades, when the fan A is driven, the air is sucked into the central space C defined at the center of the fan body 20 by stacking a multiplicity of annular circular plates 24 and air passes through the air passages defined between the annular circular plates 24,24 and air flows out in all radial directions. Then, air is heated by the heater H and is smoothly blown off from the hot air outlet 40. In the above flow of air, the propulsion of air to the outside is enhanced by the provision of the blades 25.

Figure 11:
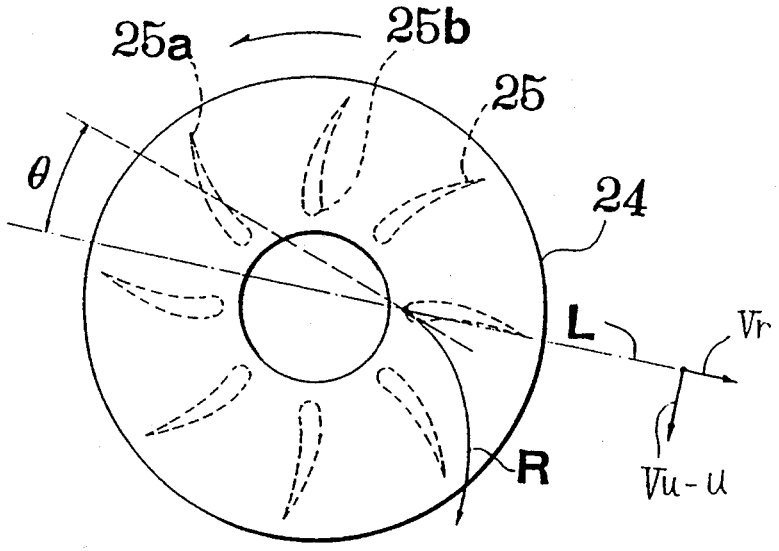
FIG. 11 is an explanatory view showing the desirable backward attack angle of the blade of the multi-stacked circular plate fan provided with blades accoriding to the fourth embodiment.

As shown in FIG. 11, the blade 25 has the trailing edge **25*a* thereof backwardly inclined which is opposite to the rotating direction of the annular circular plate 24**.

Figure 15:
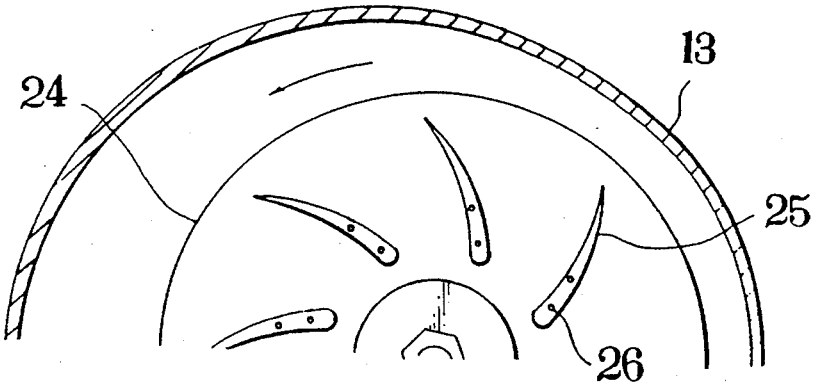
FIG. 15 is an explanatory view showing the undesirable backward attack angle of the blade.
Figure 16:
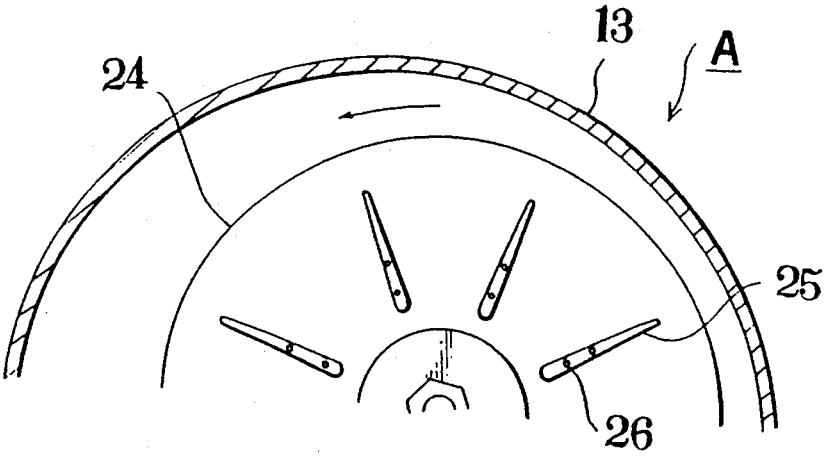
FIG. 16 is an explanatory view of the multi-stacked circular plate fan provided with blades having no inclination.

The reason for adoption of the rearwadly inclined blade as the blade 25 of the fan is that with the frontwardly inclined blade 25 shown in FIG. 15 or the radially extending blade 25, the fluid disposed at the range of the blade flows at the tangetial speed which is equal to or more than the rotational speed of the annular circular plate 24, while once the fluid is out of the range of the blade 25, the speed of the fluid is reduced by the friction on the surface of the annular circular plate 24 and causes loss.

To the contrary, as shown in FIG. 11, in case the backwardly inclined blade is adopted as the blade 25, not only the centrifugal force generated by the frictional force between the annular circular plate 24 and the fluid but also the air blow force generated by the working of the blade 25 is increased thus enabling the air propulsion with the least occurrence of the turbulence.

The applicant also has found that when the backwardly inclined angle, namely a blade mounting angle θ relative to the annular circular plate 24 is chosen appropriately relative to the locus R of air which flows in the air passage between the annular circular plates 24,24, the noise reduction caused by the rotation of the multi-stacked circular plate fan A provided with blades can be effectively enhanced.

Namely, it was found by the experiment that in case the blade mounting angle θ at the inlet side of the annular circular plate 24 formed by the locus R of the air flowing between the annular circular plates 24,24 and a chord L which connects the trailing edge **25*a* and the leading edge 25*b*** is set at 20°±15°, the noise can be reduced greatly while assuring a sufficient air blow amount.

Figure 12:
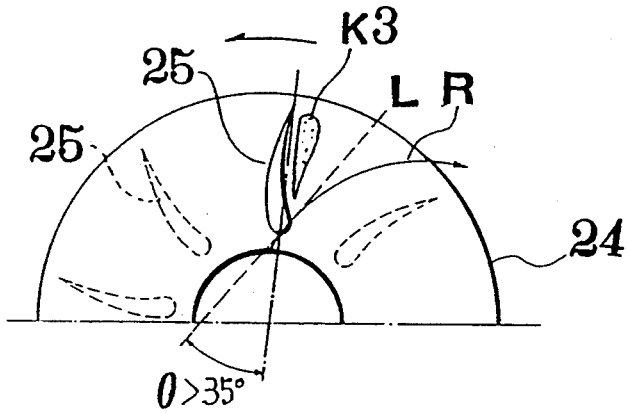
FIG. 12 is an explanatory view showing the undesirable backward elavation angle of the blade of the multi-stacked circular plate fan provided with blades.
Figure 13:
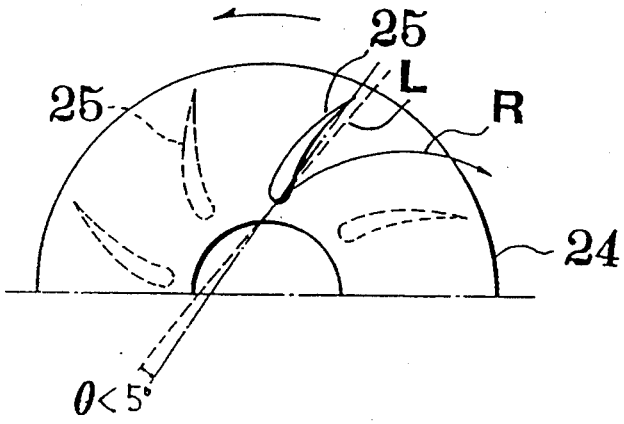
FIG. 13 is an explanatory view showing the undesirable backward attack angle of the blade of the multi-stacked circular plate fan provided with blades.

The reason for setting the blade mounting angle θ at 20°±15° is as follows. Namely, as shown in FIG. 12, in case the blade mounting angle θ is greater than the maximum angle of 35°, the turbulence including the voltices is generated by the peeling off of air on the suction surface $k_3$ so that the air expelling sound is greatly increased or the air expelling performance becomes unstable thus remarkably increasing the noise. On the other hand, as shown in FIG. 13, in case the blade mounting angle θ is smaller than the minimum angle of 5°, the blade can hardly carry out its function or the blade 25 works as the resistance against the flow of air thus deteriorating the performance of the fan and increases the specific noise.

The locus R of air which flows in the air passage can be readily obtained in a following manner.

Firstly, with the following formulae (6) and (7), the circumferential velocity (Vu-U) and the radial velocity Vr relative to the air flow which passes through the annular circular plates 24,24 are obtained.

[circumferential velocity (Vu-U)]

$$\frac{Vu}{U} = 1 - \frac{A}{12\pi(r/r_i)^2} + \left(\frac{A}{12\pi} - 1\right)\frac{1}{(r/r_i)^2} \times e^{12\pi\cdot(1-(r/r_i))/A} \quad (6)$$

From the velocity Vu obtained from the formula (6), the circumferential velocity (Vu-U) can be obtained.

[radial velocity Vr]

From Bernoulli's equation of continuity, $$V_r = q/2\,\pi r\delta \quad (7)$$

From the formulae (6) and (7), the position of air at one point of the annular circular plate 24 after Δt seconds is obtained as $x = x_0 + \Delta t Vr$, $y = y_0 + \Delta t\ (Vu \cdot U)$. Here, Δt is 0.

The position of air obtained in the above manner is continuosly connected and the locus R can be readily obtained.

In the above formula,

A: non-dimentional flow amount ($= q\delta_D/\nu\ r_i^2$)

Vu: circumferential velocity of air at a desired radius m/s

Figure 14:
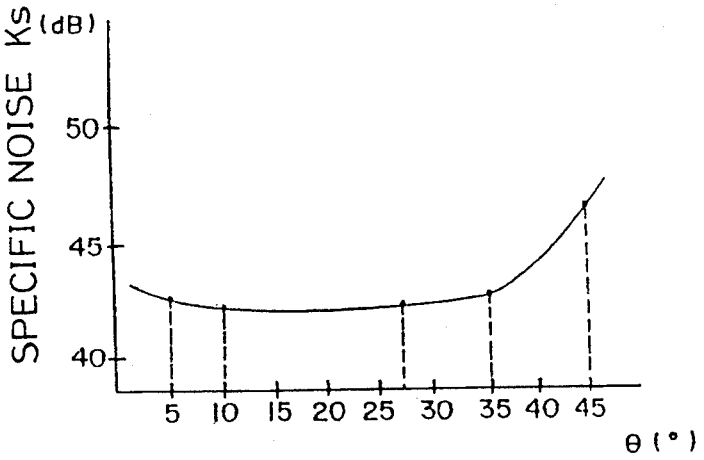
FIG. 14 is a graph showing the relationship between the attack angle and the specific noise level.

Vr: radial velocity of air at a desired radius m/s
U: circumferential velocity of circular plate at a desired radius m/s
δ: gap between two annular circular plates m
q: amount of air which passes through two annular circular plates $m^3/s$
r: a desired radius m
ri: radius at the inlet of annular circular plate m
ν: kinematic viscosity $m^2/s$
μ: viscosity coefficient kgs/s In Table 2, the specific noise levels ks which are measured by varying the blade mounting angle (attack angle) θ while in FIG. 14, the above-measured specific noise level is taken on the ordinate.

TABLE 2

| attack angle | specific noise ks |
|---|---|
| 5° | 42.5 |
| 10.5° | 42 |
| 27.5° | 42 |
| 35° | 42.5 |
| 45° | 47 |

As can be understood from the Table 2 and the graph in FIG. 14, when the blade mounting angle θ is within the range of 5°, the specific noise is decreased and especially, when the blade mounting angle θ is within the range of 5°, the specific noise is noticeably decreased.

As described above, this embodiment is, as shown in FIG. 11, characterized in that the blade 25 is backwardly inclined and the attack angle θ is set to be 20°±15°. However, the shape and the manner of arrangement are not limited to those which are shown in FIG. 11. For example, the multi-stacked circular plate fan A can adopt the blades 25 which are shown in FIG. 17 and FIG. 18.

Figure 17:
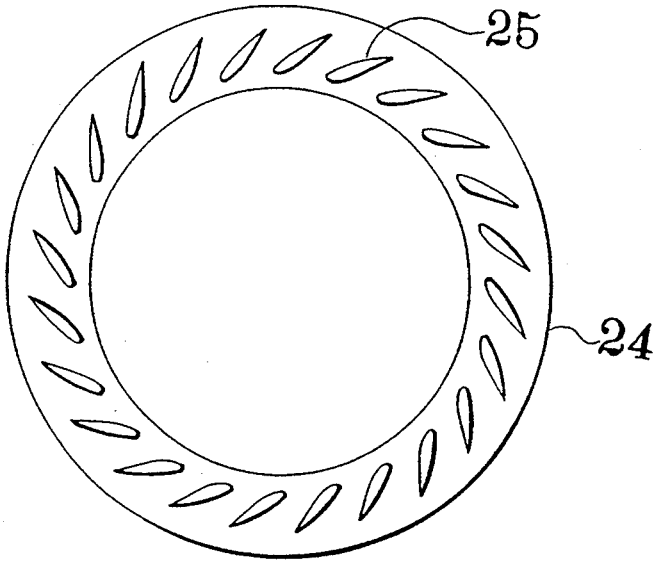
FIG. 17 is an explanatory view showing the modification of the blade having the backward attack angle.
Figure 18:
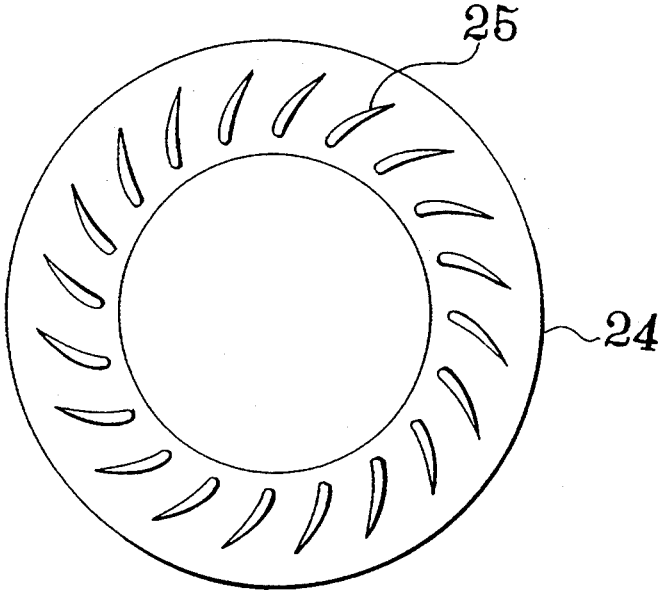
FIG. 18 is an explanatory view showing the modification of the blade having the backward attack angle.

Namely, in FIG. 17, the blade 25 has a completely straight linear shape, while in FIG. 18, the blade 25 has a slightly arcuate shape.

Fifth Embodiment

Figure 19:
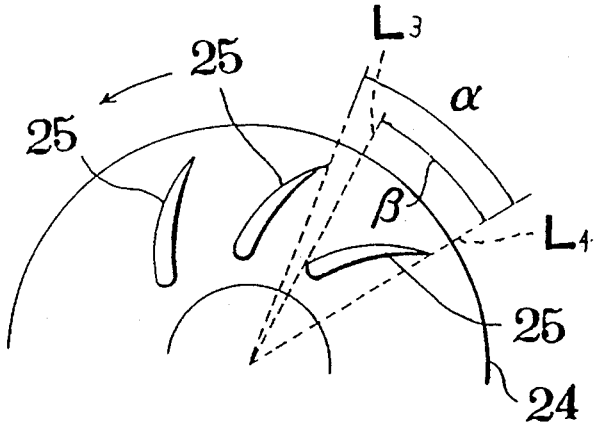
FIG. 19 is an enlarged view of the substantial part of the multi-stacked circular plate fan provided with blades according to the fifth embodiment.

This embodiment is characterized in that, as shown in FIG. 19, the relationship between an angle α between blades 25,25 and an angle β which is defined by lines $L_3$ and $L_4$ made by connecting the leading edge and the trailing edge of the blade 25 with the center of the annular circular plate 24 is set to be $0.5<\beta/\alpha<1$.

The reason for predetermining the circumferential pitch angle α between the blade 25,25 at $0.5<\beta/\alpha<1$ is as follows.

Figure 20:
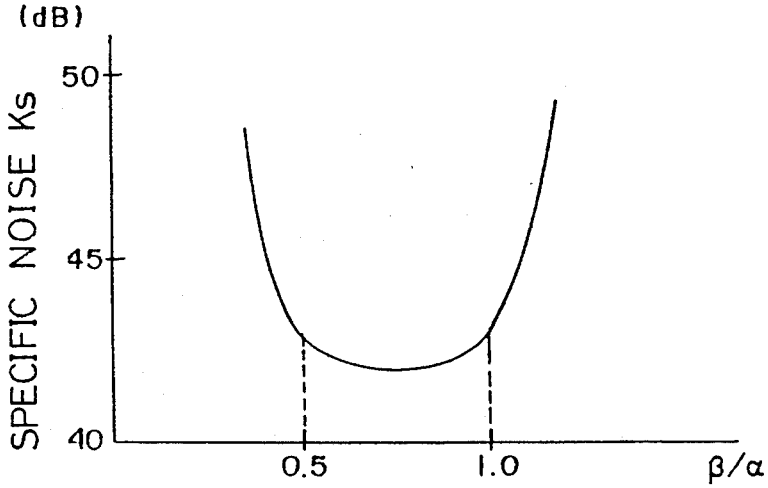
FIG. 20 is a graph showing the relationship between the rate between pitch of the blade and the blade mounting angle and the specific noise level.

Namely, if β/α is smaller than 0.5 or the circumferential pitch angle between the blades 25,25 is greater than β/0.5, the working of the blades 25,25 is lowered as shown in the table below (Table 3) and the graph shown in FIG. 20 so that the amount and the pressure of air are both decreased and the velocity distortion between the trailing edge s of the blades 25,25 is increased and the turbulence noise and the interference noise are increased.

If β/α is greater than 1 or if the circumferential pitch angle between the blades 25,25 is narrower than β, the passage of air flow which passes through the blades 25,25 is narrowed and the pressure loss in the passage is increased so that the pressure is rapidly decreased. Accordingly, the optimal value should be in the above range.

TABLE 3

| β/α | specific noise |
|---|---|
| 1.2 | 48 |
| 1.0 | 44 |
| 0.8 | 43 |
| 0.5 | 44 |
| 0.4 | 47 |

Embodiment 6

This embodiment is characterized in that in the multi-stacked circular plate fan A provided with blades, if the relationship among the gap δ, the kinematic viscosity of air and the angular velocity of the annular circular plate 24 is chosen at a predetermined rate, the operational noise of the multi-stacked circular plate fan A provided with blades can be reduced.

Namely, in the multi-stacked circular plate fan A, Breiter et al suggests the optimal gap between the annular circular plates 25,25 in the following formula.

$$\frac{\delta}{\pi(\nu/\omega)^{\frac{1}{2}}} = 1 \tag{8}$$

In the formula,

ν=kinematic viscosity ($m^2/s$)
ω=angular velocity (rad/s)

Figure 21:
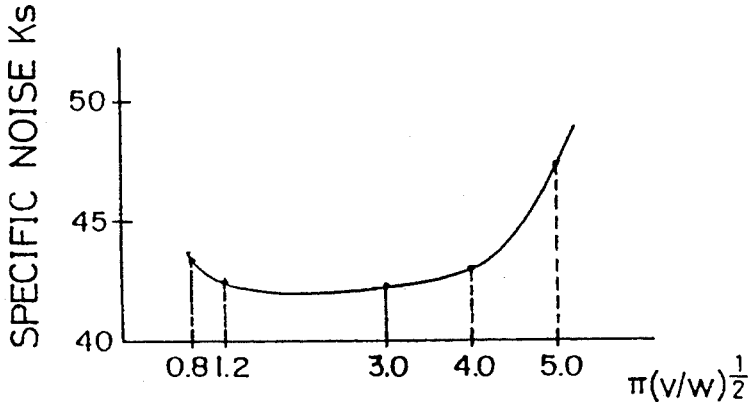
FIG. 21 is a graph showing the relationship between the circumferential velocity and the specific noise level according to the sixth embodiment.

The applicant carried out an experiment to examine the validity of the above formula in the multi-stacked circular plate Fan A provided with blades on the condition that the number of the blades 25 is set at $Z \geqq 8$ and obtained the result exhibited in the graph shown in FIG. 21.

As can be understood from the graph, in the multi-stacked circular plate fan provided with blades, if the $\delta/(\nu/\omega)^{\frac{1}{2}}$ is in the range of 0.8 to 4.0, more specifically in the range of 1.2 to 3.0, the specific noise level was remarkably decreased.

In this manner, the reason why the appropriate gap δ between the annular circular plates 25,25 was increased if the multi-stacked circular plate fan A provided with blades increases the number of blades 25 is that as the gap δ is widened, the blade 25 can work more efficiently so that the air dynamic performance can be increased and the specific noise level ks was decreased. On the other hand, if the gap δ is widened excessively, the laminar flow effect caused by the circular plates 25 is lost and the noise is increased. Accordingly, the value should be in the optimal range.

Seventh Embodiment

This embodiment is characterized in that the gap δ between the annular circular plates 25,25 in the multi-stacked circular plate fan A provided with blades is determined in view of the Reynold's number of air.

In the sirocco fan, the flow of fluid tends to generate vortices at the blade portions whereas in the multi-stacked circular plate fan provided with blades, a multiplicity of annular circular plates 24 are stacked so that such vortices can restrict the occurrence of the turbulence.

Figure 22:
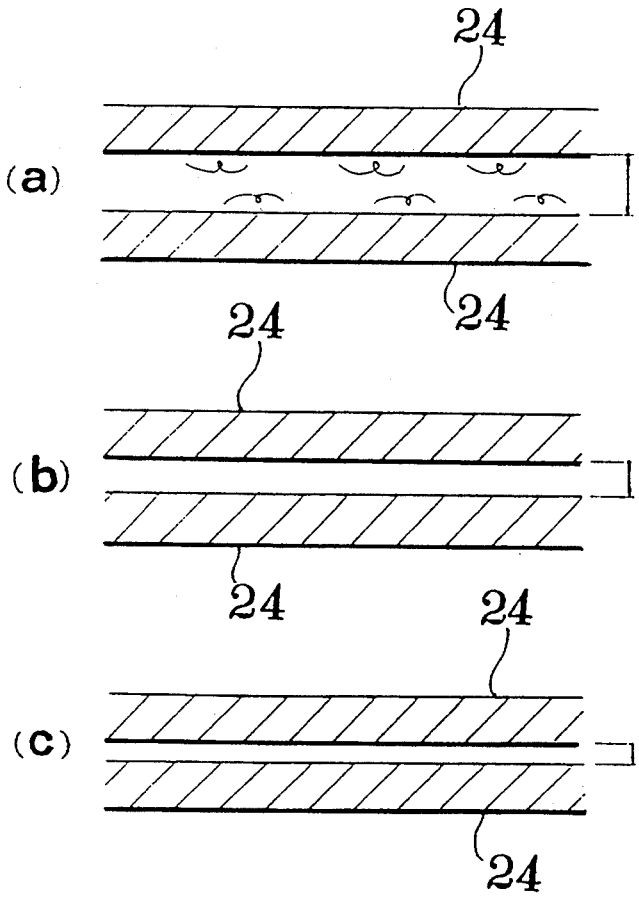
FIGS. 22(*a*), 22(*b*) and 22(*c*) are the explanatory views showing the air flow passing through the gap between the annular circular plates according to the seventh embodiment.
Figure 23:
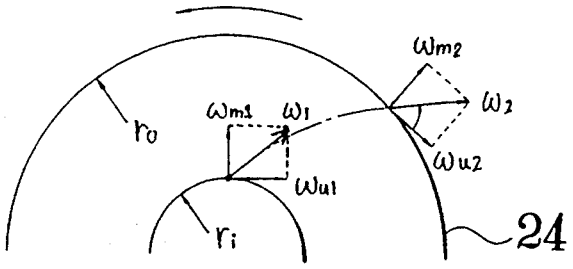
FIG. 23 is an explanatory view showing the flow of air.

As shown in FIG. 22(*a*), however, when the gap δ between the annular circular plates 24,24 is excessively widened, the vortices and the turbulence are generated between the annular circular plates 24,24, while as shown in FIG. 22(*c*), if the gap δ between the annular circular plates 24,24 is excessively narrow, although no vortices or turbulence occurs between the annular circular plates 24,24, the fan provides little air blow function due to flow resistance in the air passage.

Accordingly, the applicant has evaluated the optimal gap which can assure the sufficient amount of expelling air while minimizing the occurrence of the vortices and the turbulence and found that if the gap δ between the annular circular plates 24,24 with respect to the Reynold's number is set in a predetermined range, the fan can exhibit the sufficient amount of expelling air and little vortices or turbulence.

Namely, in the multi-stacked circular plate fan A provided with blades, a following relationship exists between the gap δ and the Reynold's number.

Namely, assuming that the number of annular circular plates 24 being B and the air amount being Q ($m^3$/min ), the relative velocity at the inlet can be obtained by a following formula provided that air enters radially relative to the multi-stacked circular plate fan A.

$$\omega_{m1} = \frac{Q}{60\pi \cdot 2r_i \cdot \delta \cdot B} \tag{9}$$

If the air completely slips in a circumferential direction, $$\omega_{u1} = \frac{2\pi\, r_i\, n}{60} \tag{10}$$

$$\omega_1 = \sqrt{\omega_{m1}^2 + \omega_{u1}^2} \tag{11}$$

From above formulae, the relationship between the Reynold's number Re and the gap between the annular circular plates 24,24 can be obtained by a following formula.

$$Re = \frac{\omega_1 \cdot \delta}{\nu} \tag{12}$$

In the above formula, each symbol has following meanings.

Figure 24:
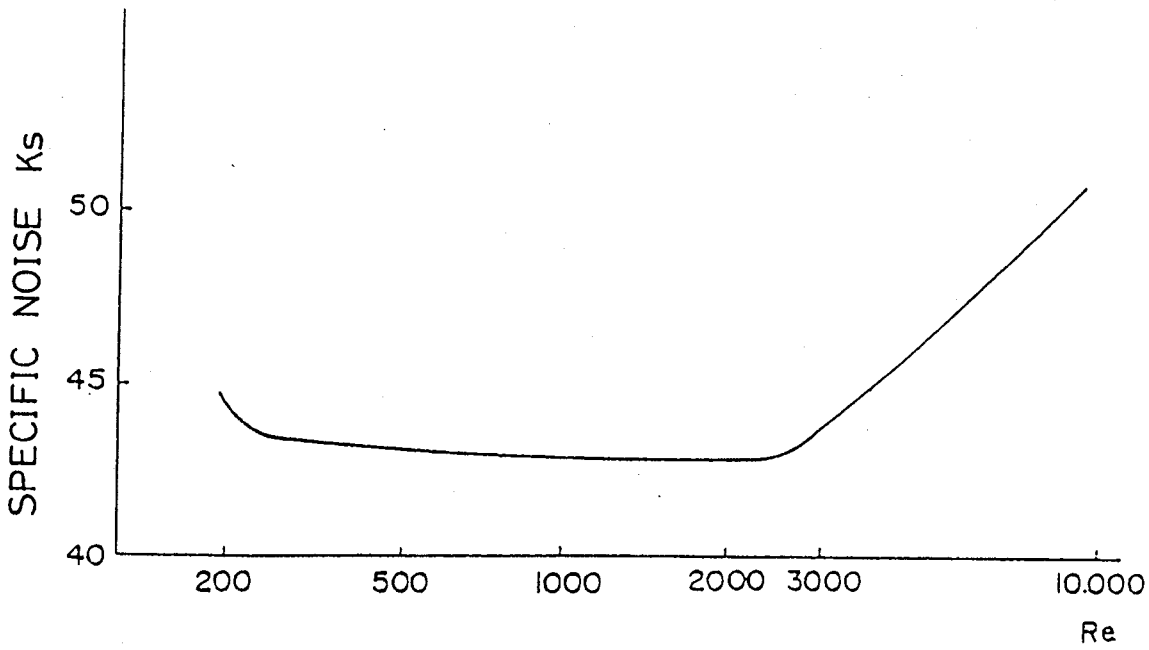
FIG. 24 is a graph showing the relationship between the Reynold's number and the specific noise level.
Figure 25:
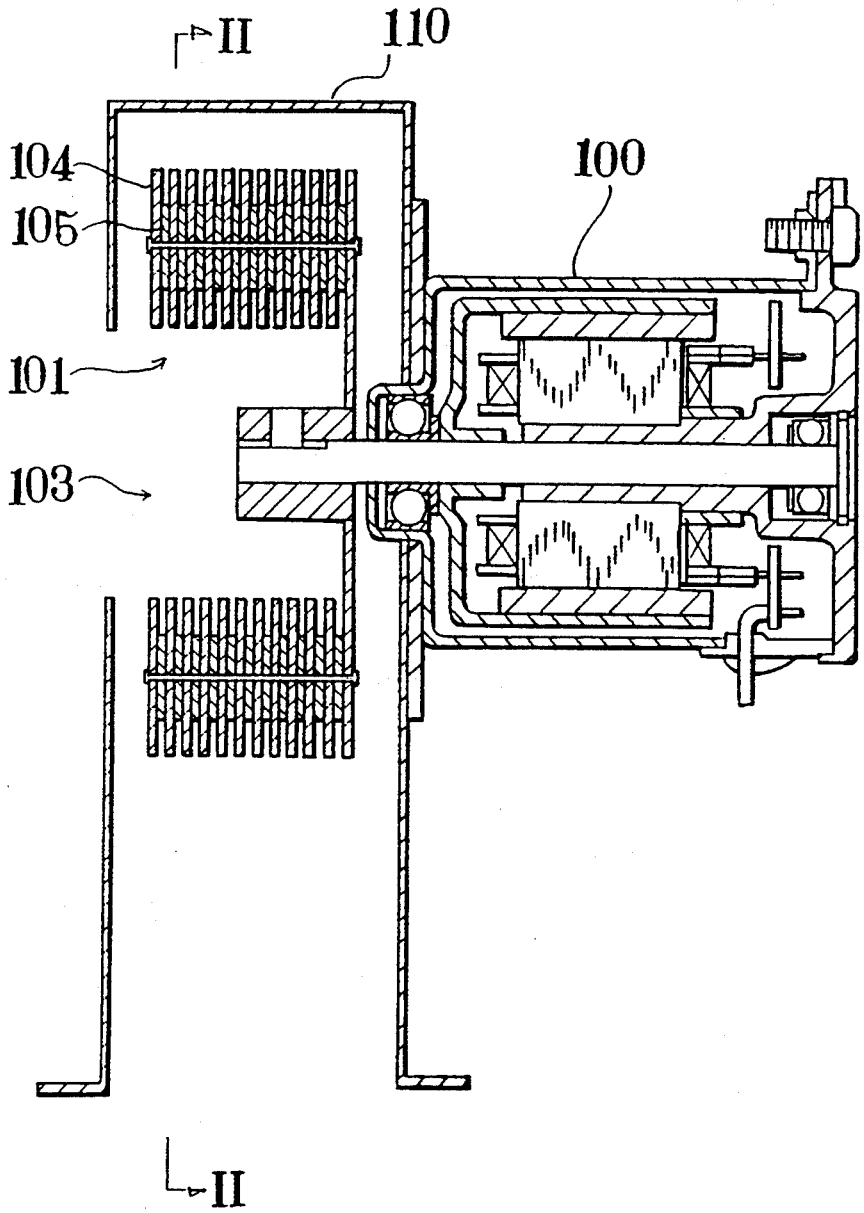
FIG. 25 is a cross-sectional side view showing the conventional multi-stacked circular plate fan provided with blades.
Figure 26:
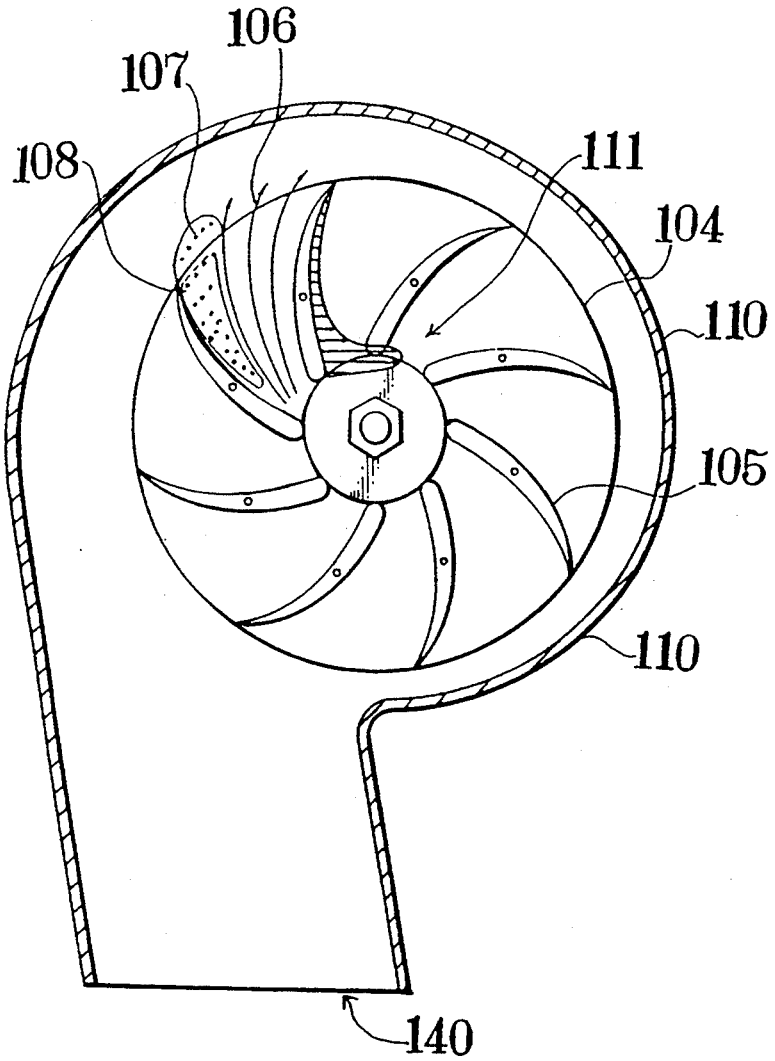
FIG. 26 is a cross-sectional view taken along the line II—II of FIG. 25.
Figure 28:
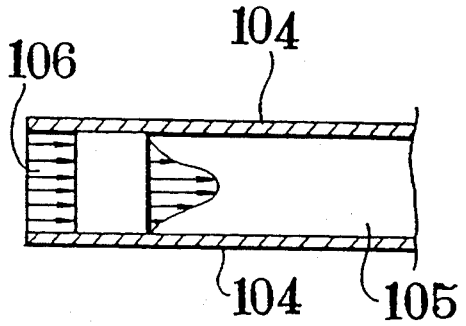
FIG. 28 is an explanatory view showing the velocity distribution of the air flow between the annular circular plates.
Figure 27:
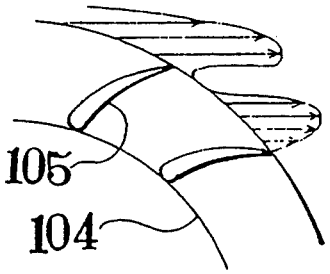
FIG. 27 is an explanatory view showing the air flow on the annular circular plate.

$\omega m_1$: relative angular velocity of air at the inlet $\omega m_1$: circumferential angular velocity of air at the inlet $\omega_1$: relative velocity of air at the inlet $\nu$: kinematic viscosity of air $r_1$: inlet radius of annular circular plate Meanwhile, the result of the experiment carried by the applicant in which the gap between the annular circular plates 24,24 was varied within the range of 200 to 1000 of the Reynold's number is shown in FIG. 24.

From the graph shown in FIG. 24, for effectively lowering the noise level, it is desirable to take the relationship between the Reynold's number and the gap δ in a following range.

$$200 < \frac{\omega_1 \cdot \delta}{\nu} (=Re) < 3000 \tag{13}$$

Due to above-mentioned construction, the present invention has following advantages.

Namely, The present invention discloses a multi-stacked circular plate fan provided with blades which is formed by stacking a multiplicity of annular plate while maintaining a desired gap therebetween, characterized in that a multiplicity of blades are interposed between the annular circular plates and at least either of the trailing edge or the leading edge of the blade is positioned a predetermined distance to the inside from the outer periphery of the annular circular plate or a predetermined distance to the outside from the inner periphery of the annular circular plate.

Due to the laminar flow effect caused by the annular circular plates, the turbulent flow which is produced at the leading and trailing edges of the blades by peeling-off of air can be minimized and furthermore, since no outlet velocity distortion occurs at the outer periphery of the annular circular plates, the turbulent noise and the interference noise can be lowered thus providing the silent fan operation.

Furthermore, with the provision of backwardly inclined blade or by making an angle which is formed at the leading edge of the blade by a locus of the fluid obtained by the circumferential velocity and the radial velocity as relative velocities of fluid which flows between annular plates and a chord which connect the leading edge and the trailing edge of the blade is determined at 20°±15°, the fan can increase the air expelling capacity while assuring the silent operation.

Furthermore, the relationship between a circumferential pitch angle between blades and an angle defined by lines formed by connecting the leading edge and the trailing edge of the blade with the center of the annular circular plate is determined at 0.5 to 1 so that an optimal air flow passage is established. Therefore, the fan can increase the air expelling capacity while assuring the silent operation.

Furthermore, the optimal operation range exists in the relationship between the gap between the annular circular plates and the rotation of the fan or the velocity of air flow at the outlet of the circular plate, wherein in the above range, due to the laminar effect of the circular plates, the turbulent flow which is produced at the leading and trailing edges of the blades by peeling-off of air can be minimized and the the outlet velocity distortion occurs at the outer periphery of the annular circular plates can be suppressed, the turbulent noise and the interference noise can be lowered thus providing the silent fan operation.

Although the present invention is explained specifically with respect to several embodiments, the present invention is not restricted to the invention disclosed in those embodiments and rather the multi-stacked circular plate fan according to the present invention can be preferably used in any other technical fields or applications which require the silent air expelling operation such as the heat exchanger besides the hot air blow fan.

We claim:

1. A multi-stacked circular plate fan provided with blades, comprising:

a multiplicity of circular plates stacked in measured spaced relation defining a stacked annular plate assembly having a central circular air inlet opening and a plurality of annular circular layers of air between an adjacent pair of said annular plates and communicating with said central air inlet opening, spacings of said layer of air being determined to generate a laminar air flow upon rotation of said stacked annular plate assembly, said each annular circular solid plate having a flattened surface on both surfaces thereof;

a multiplicity of blades being interposed between said annular plates in a circumferentially measured spaced relation, said blades extending radially and being operable as means for enhancing the propulsion of laminar air flow and for defining an accurate space between said annular plates;

means for rotating said annular plates such that a spacing of said annular plates produces a centrifugal blowing function utilizing centrifugal force, resulting from circular movement of the air due to shear forces, and said air is expelled in a laminar flow from said stacked annular plate assembly along with a logarithmic spiral path from said central air inlet opening to an outer circumferential periphery of said annular plates guided by said blades;

wherein the distance ($S_1$) between the trailing edge of each of said multiplicity of blades and the inside of the outer periphery of each of said plurality of annular circular plates is defined by a following formula:

$$0.3 < \frac{S_1}{l} \cdot \left[\frac{Vu_1}{Vr_1}\right]^{\frac{1}{3}} < 1.2$$

In the formula, l: pitch between blades (mm)

$Vu_1$: tangential velocity of fluid at the radius of the trailing edge of the blade (m/s)

$Vr_1$: radial velocity of fluid at the radius of the trailing edge of the blade (m/s)

2. A multi-stacked circular plate fan provided with blades, according to claim 1 wherein the distance ($S_2$) which predetermined distance is in circumferentially measured spaced relation to the outside from the inner periphery of the annular circular plate and determined at a value of $0.025 < S_2/r_2 < 0.125$ with relation to the radius ($r_2$) of the annular circular plate at the leading edge of the blade.

3. A multi-stacked circular plate fan provided with blades, according to claim 1, wherein each of said multiplicity of blades is mounted in such a manner that it is inclined in a backward direction opposite to the rotating direction of said multiplicity of annular circular plates.

4. A multi-stacked circular plate fan provided with blades, according to claim 1, wherein an attack angle ($\theta$) which is formed at the leading edge of each said blade by a chord (L) which connects the leading edge and the trailing edge of each said blade and a locus of the fluid obtained by the circumferential velocity and radial velocity as relative velocities of fluid which flows between annular circular plates is determined at about 20 degrees plus or minus 15 degrees.

5. A multi-stacked circular plate fan provided with blades, according to claim 1, wherein the relationship between a pitch angle ($\alpha$) between each pair of said blades and an angle ($\beta$) defined by the lines ($L_3$), ($L_4$) formed by connecting the leading edge and the trailing edge of each said blade with the center of each said annular circular plate is determined at $0.5 < \beta/\alpha < 1$.

6. A multi-stacked circular plate fan provided with blades, according to claim 1, wherein the gap ($\delta$) between said annular circular plates is determined at a value defined by a following formula:

$$0.8 < \frac{\delta}{\pi(\nu/\omega)^{\frac{1}{2}}} < 4.0$$

In the formula, $\nu$=kinematic viscosity ($m^2/s$)

$\omega$=angular velocity (rad/s)

7. A multi-stacked circular plate fan provided with blades, according to claim 1, wherein the gap ($\delta$) between said annular circular plates is determined at a value defined by a following formula:

$$200 < \frac{\omega_1 \cdot \delta}{\nu} (=Re) < 3000$$

In the formula, $\omega_1$=relative angular velocity at the inlet portion between air and annular circular plate (m/s)

$\nu$=kinematic viscosity ($m^2/s$)

Re=Reynold's number

8. A multi-stacked circular plate fan provided with blades, according to claim 1, wherein each said blade is oriented such that each first blade position and subsequent blade position corresponds by way of conformal transformation.

9. A multi-stacked circular plate fan provided with blades, according to claim 1, wherein each said blade has a streamlined shape.

* * * * *